US006932779B2

(12) United States Patent
Kasai

(10) Patent No.: US 6,932,779 B2
(45) Date of Patent: Aug. 23, 2005

(54) METHOD OF CONTROLLING MASSAGING MACHINE

(75) Inventor: Eiji Kasai, Kyoto (JP)

(73) Assignee: OMRON Corporation, Kyoto (JP)

( * ) Notice: Subject to any disclaimer, the term of this patent is extended or adjusted under 35 U.S.C. 154(b) by 144 days.

(21) Appl. No.: 10/186,955

(22) Filed: Jun. 27, 2002

(65) Prior Publication Data

US 2003/0032903 A1 Feb. 13, 2003

(30) Foreign Application Priority Data

Jul. 31, 2001 (JP) ..... 2001-232683

(51) Int. Cl.[7] ..... A61H 15/00

(52) U.S. Cl. ..... 601/99; 601/100; 601/103; 601/116

(58) Field of Search ..... 601/46, 48, 49, 601/56, 57, 58, 59, 60, 70, 97, 98, 99, 111, 100, 101, 102, 103, 107, 108, 115, 116

(56) References Cited

U.S. PATENT DOCUMENTS

| | | | | | |
|---|---|---|---|---|---|
| 4,718,408 | A | * | 1/1988 | Barreiro | 601/99 |
| 5,022,384 | A | * | 6/1991 | Freels et al. | 601/57 |
| 5,575,761 | A | | 11/1996 | Hajianpour | 601/48 |
| 6,027,463 | A | * | 2/2000 | Moriyasu | 601/46 |
| 6,039,702 | A | | 3/2000 | Cutler et al. | 601/46 |
| 6,077,238 | A | | 6/2000 | Chung | 601/57 |
| 6,083,181 | A | * | 7/2000 | Marcantoni | 601/99 |
| 6,087,942 | A | * | 7/2000 | Sleichter et al. | 601/49 |
| 6,224,563 | B1 | * | 5/2001 | Nonoue et al. | 601/99 |

FOREIGN PATENT DOCUMENTS

WO 01/19316 3/2001

* cited by examiner

*Primary Examiner*—Danton D. DeMille
*Assistant Examiner*—Quang D. Thanh
(74) *Attorney, Agent, or Firm*—Beyer Weaver & Thomas LLP

(57) ABSTRACT

In operating a massaging machine having massaging members and a motor for causing the massaging members to vibrate to massage a patient, a pulsed driving signal is applied to the motor for repetitively switching on and off the motor for specified time lengths such that the motor is intermittently activated, rather than continuously.

5 Claims, 11 Drawing Sheets

METHOD OF CONTROLLING MASSAGING MACHINE

BACKGROUND OF THE INVENTION

This invention relates to a method of controlling a massaging machine.

Physical stimuli to a human body have been classified into the following six types: stroking, kneading, pushing, vibrating, pulling and patting. These stimuli are communicated to a body surface or hypodermic soft tissues to directly stimulate the peripheral nerves so as to relax the body tension. Indirectly, they accelerate the recovery of functions of the body as a whole, thereby improving the natural healing power of the body and the natural tendency to maintain the body in a natural condition. It has been expected that such massaging stimuli have therapeutic effects.

Such stimuli used to be delivered manually, that is, by massaging. Recently, massaging machines having similar effects on the human body by means of mechanical actions are being developed.

The body contacting portion of a massaging operation is performed in different manners. The masseur may form a fist and pat the body on the side of the little finger. The strength of operation can be controlled by forming the fist tightly or lightly. The masseur may open the operating hand with all fingers stretched and pat the patient's body repeatedly on the side of the little finger so as to provide small vibrations to the body. The masseur may further clasp both hands and pat the patient's body with fingers separated so as to deliver elastic forces. Various methods of reproducing these effects mechanically have been tried and incorporated into a massaging machine in the form of a chair.

One of conventional kinds of massaging machine was comprised of a structure dedicated to a patting operation, driven by a dedicated driving circuit. Another kind included contact members to carry out a repetitive patting action. If a structure dedicated to a patting action is used, the patient can enjoy the feeling of being massaged by a live masseur but the machine tends to become noisy. If it is combined with another kind of massaging machine, it becomes too expensive to be feasible. The method of using contact members is advantageous because they can be operated by adding a simple mechanism for tapping operation and a simple program but the patient does not necessarily receive the same feeling of being treated by a live masseur because the oscillatory stimuli are delivered too continuously.

Massaging machines would be more highly valued if they were capable of delivering to the patient the feeling of being massaged by the fist or clasped hands of a masseur, but it has been a difficult proposal.

SUMMARY OF THE INVENTION

It is therefore an object of this invention to provide a method of controlling a massaging machine such that the sensation given to the patient will be closer to that given by a live masseur.

By a method according to this invention, the motor of which the rotary motion is transmitted to massaging members of a massaging machine is adapted to receive a driving signal which repeats switching on and off the motor such that the motor is operated intermittently causing the massaging members to vibrate while undergoing patting motion.

The massaging members are provided for kneading and stretching back muscles. The present invention makes effective use of such massaging members, their control mechanism and their control circuit such that the patient will have a sensation close to that received from a live masseur. Explained more in detail, the same mechanism for causing its massaging members to carry out the continuous oscillatory operation by applying a constant voltage is used but a pulsed voltage is inputted according to this invention such that the motor is switched on and off at specified intervals and is operated intermittently to cause the massaging members to vibrate such that the massaging members can provide a more pleasant sensation to the patient.

DETAILED DESCRIPTION OF THE INVENTION

Figure 1:
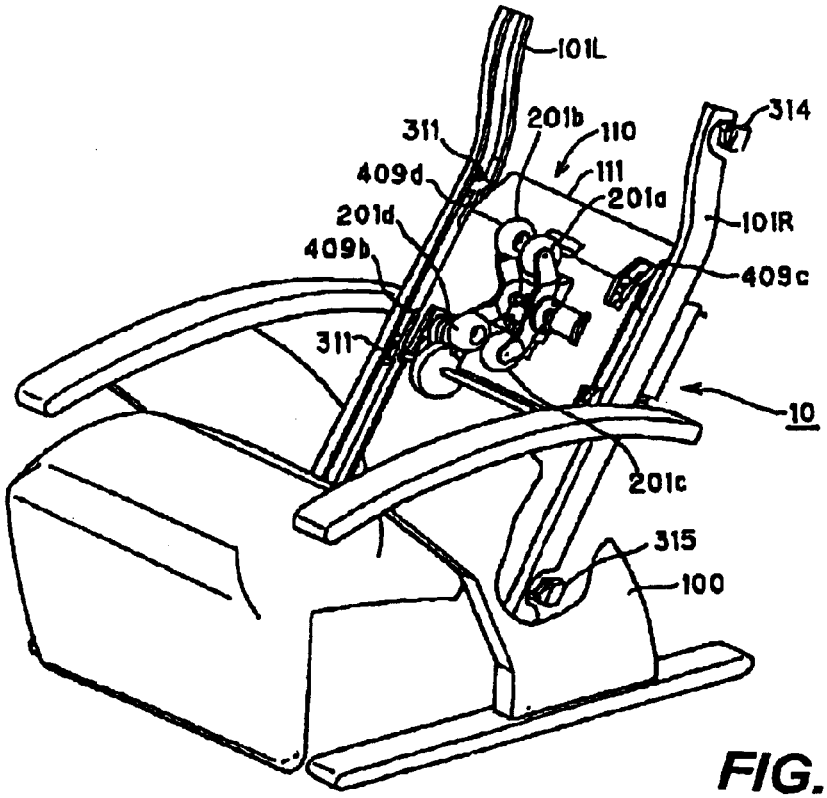
FIG. 1 is a diagonal external view of a massaging machine which may employ a method of control embodying this invention.
Figure 2:
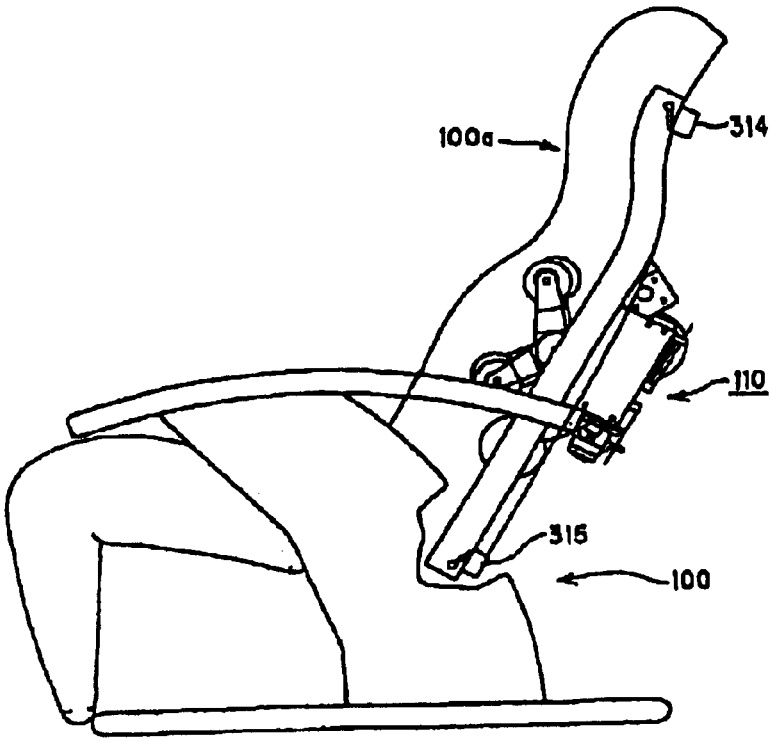
FIG. 2 is a side view of the massaging machine of FIG. 1.

A massaging machine which may be used according to this invention is described first for explaining the mechanical and electrical principles of the method of this invention. FIG. 1 is a diagonal external view of such a massaging machine 10 for schematically showing its structure (the cover sheet and the cushion on the back supporting part 100*a* being removed). FIG. 2 is its side view with the outer shape and inner structure of its back supporting part 100*a* being shown.

The massaging machine 10 is basically a reclining chair 100 with the back supporting part 100*a* incorporating a therapy unit 110 including massaging members 201*a–d*. The massaging members 201*a–d* protrude forward from the therapy unit 110 to the front surface of the back supporting part 100*a* covered by a cover sheet. The massaging members include a first pair 201*a* and 201*b* on the right-hand and left-hand sides of the back muscle and a second pair 201*c* and 201*d* similarly disposed below the first pair 201*a* and 201*b*.

The therapy unit 110 is supported by a pair of cross-sectionally U-shaped guide rails (guiding means) 101R and 101L such that the openings of their U-shapes face each other and adapted to move upward and downward along the guide rails 101R and 101L by the rotary driving motion of pinions 310 which engage with racks inside the guide rails 101R and 101L.

Figure 3:
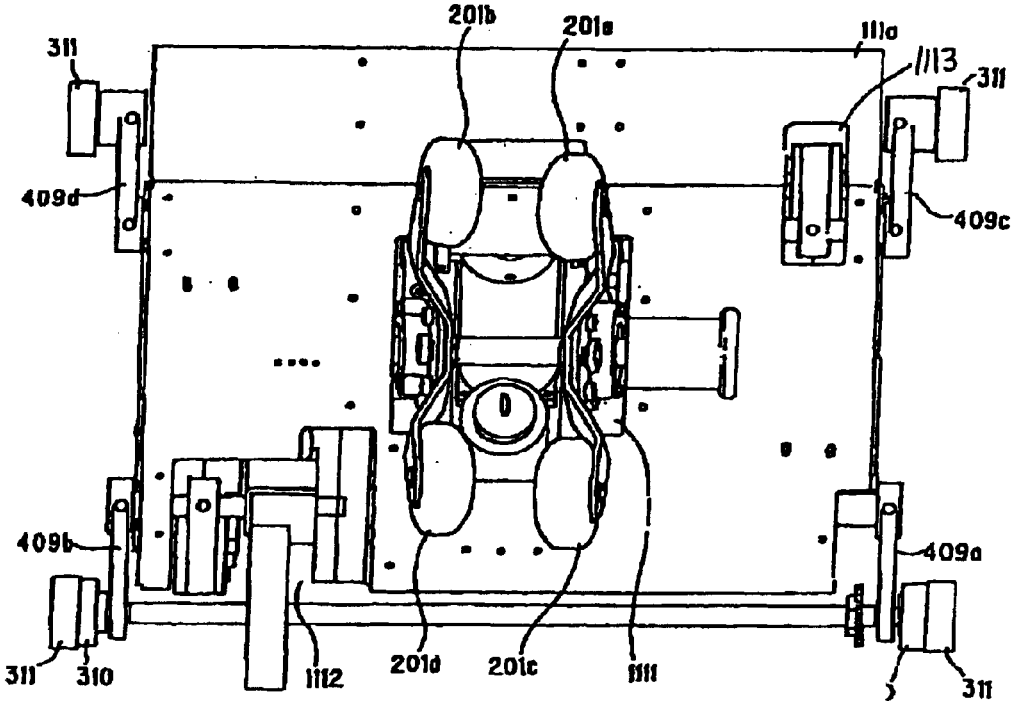
FIG. 3 is a front view of the therapy unit.
Figure 4:
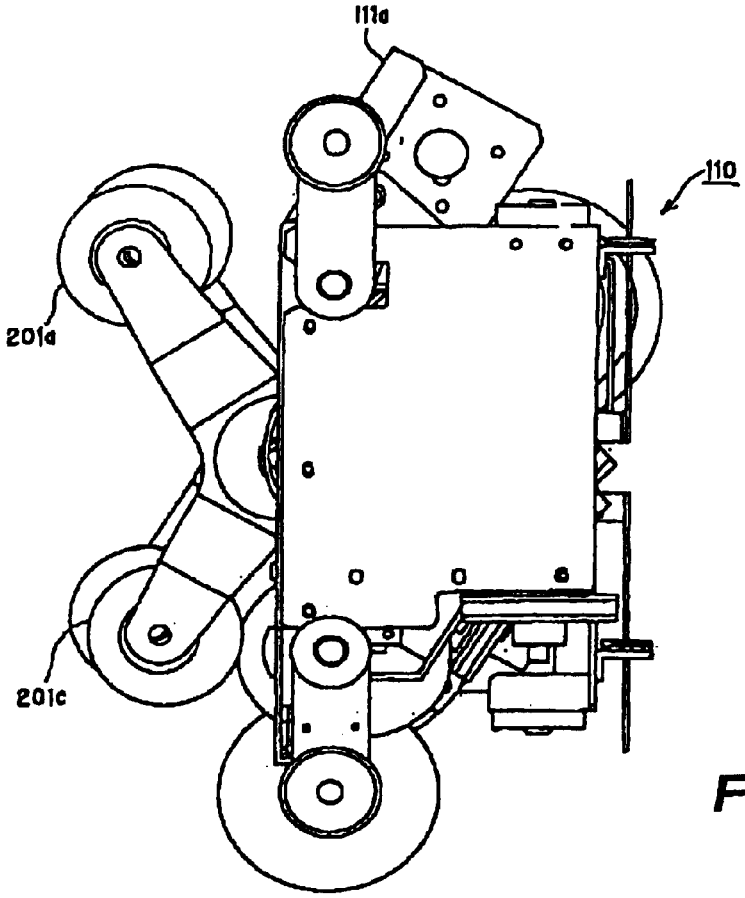
FIG. 4 is a right-hand side view of the therapy unit.
Figure 5:
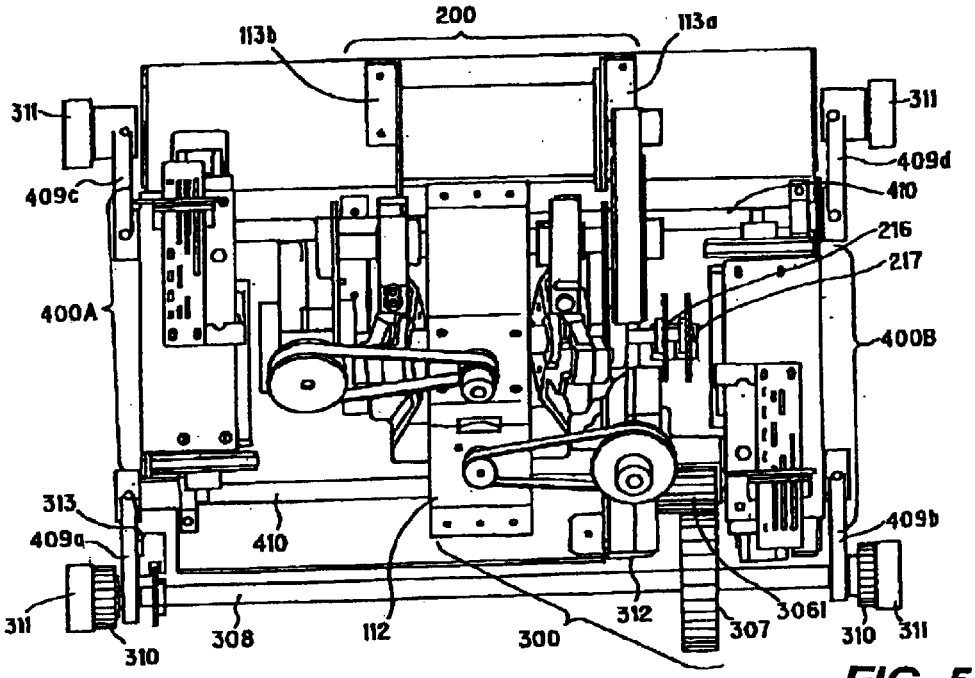
FIG. 5 is a back view of the therapy unit.
Figure 6:
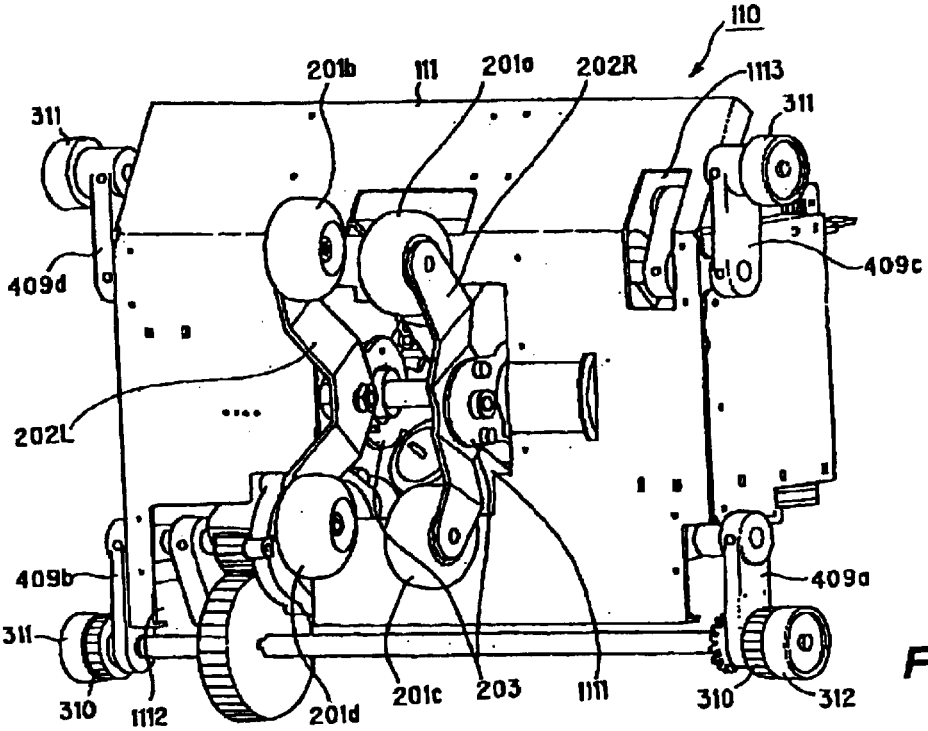
FIG. 6 is a diagonal frontal view of the therapy unit.
Figure 7:
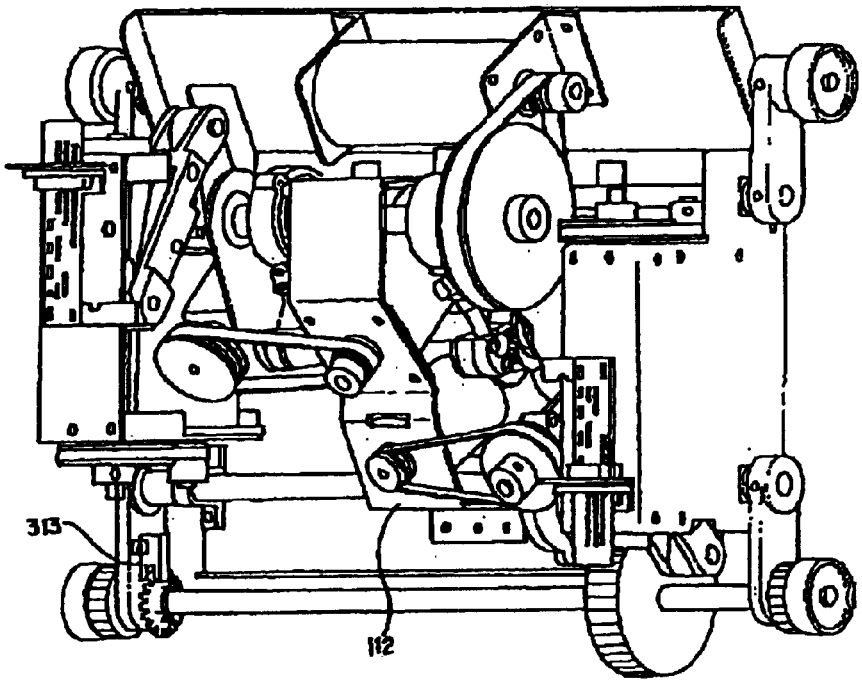
FIG. 7 is a diagonal back view of the therapy unit.

FIG. 3 is a front view of the therapy unit 110, FIG. 4 is its right-hand side view, FIG. 5 is its back view, FIG. 6 is its diagonal frontal view and FIG. 7 is its diagonal back view. The front surface of the therapy unit 110 is covered with a planar base board 111 with its upper end part bent backward and its middle part provided with an approximately rectangular opening 1111 through which the massaging members 201*a–d* protrude. The base board 111 also includes a removed portion 1112 and an opening 1113 so as to prevent possible interference with moving parts such as a gear.

Figure 8:
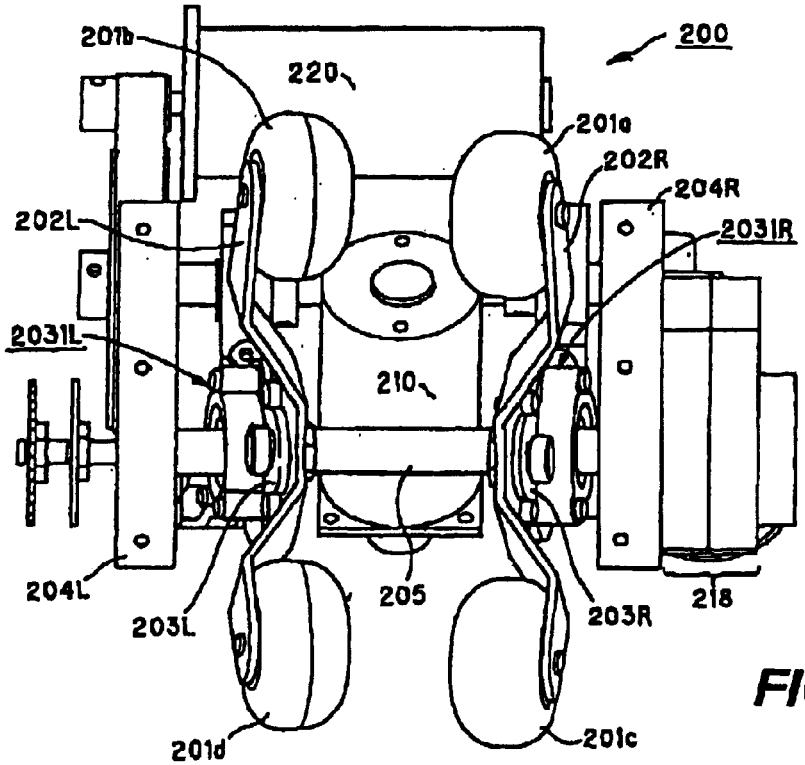
FIG. 8 is a front view of the treatment part.
Figure 9:
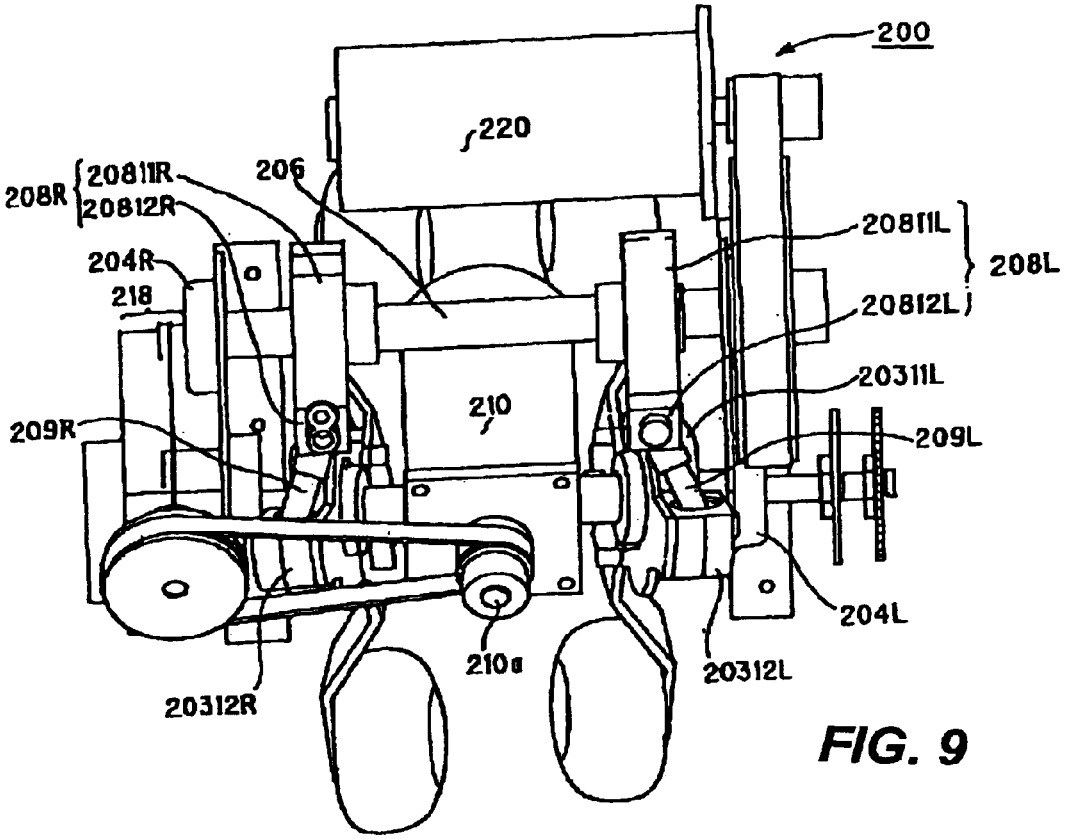
FIG. 9 is a back view of the treatment part.
Figure 10:
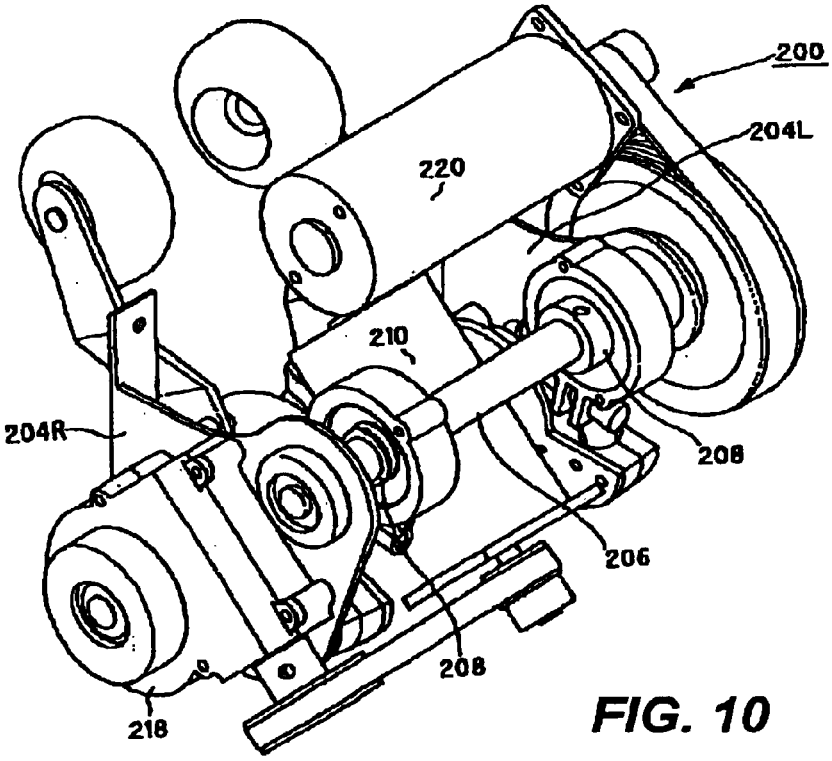
FIG. 10 is a diagonal back view of the treatment part taken from an upward position.
Figure 11:
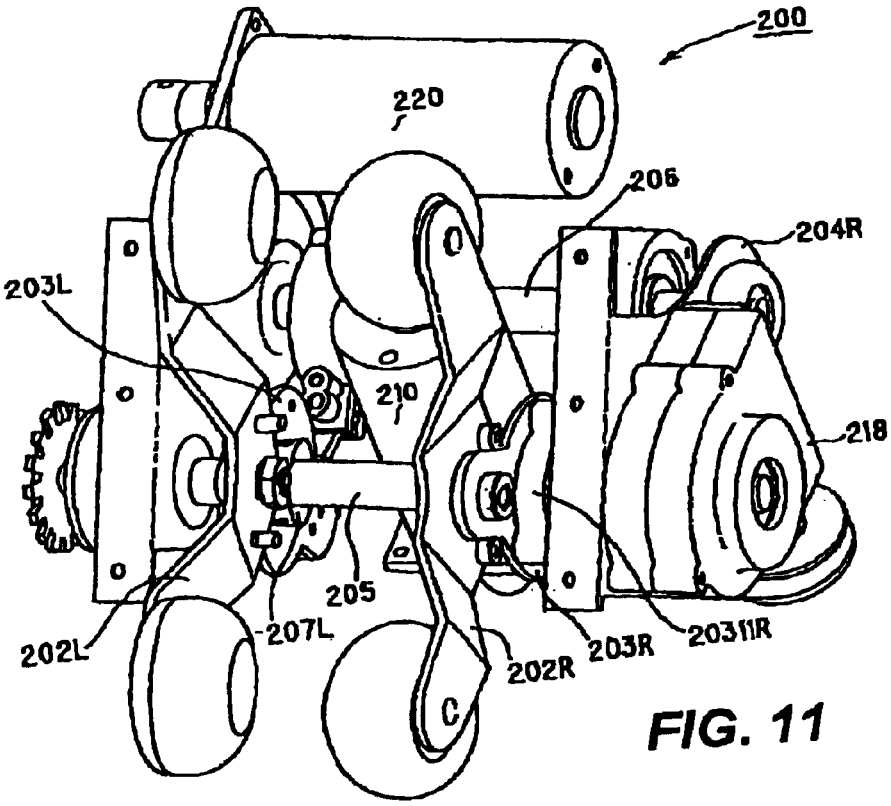
FIG. 11 is a frontal view of the treatment part taken from its right-hand side.
Figure 12:
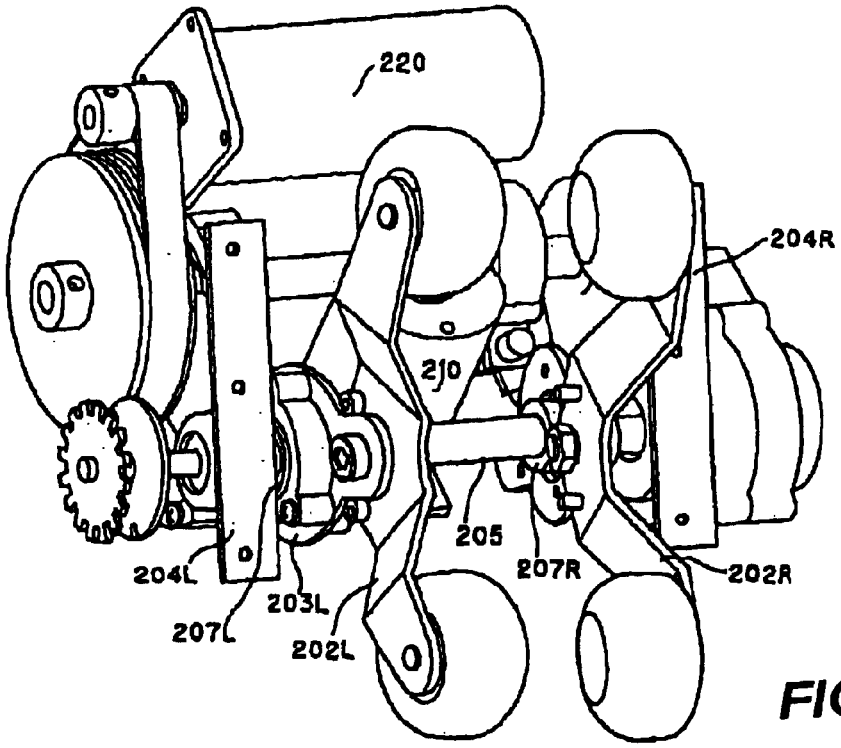
FIG. 12 is a diagonal frontal view of the treatment part taken from the left-hand side.
Figure 13:
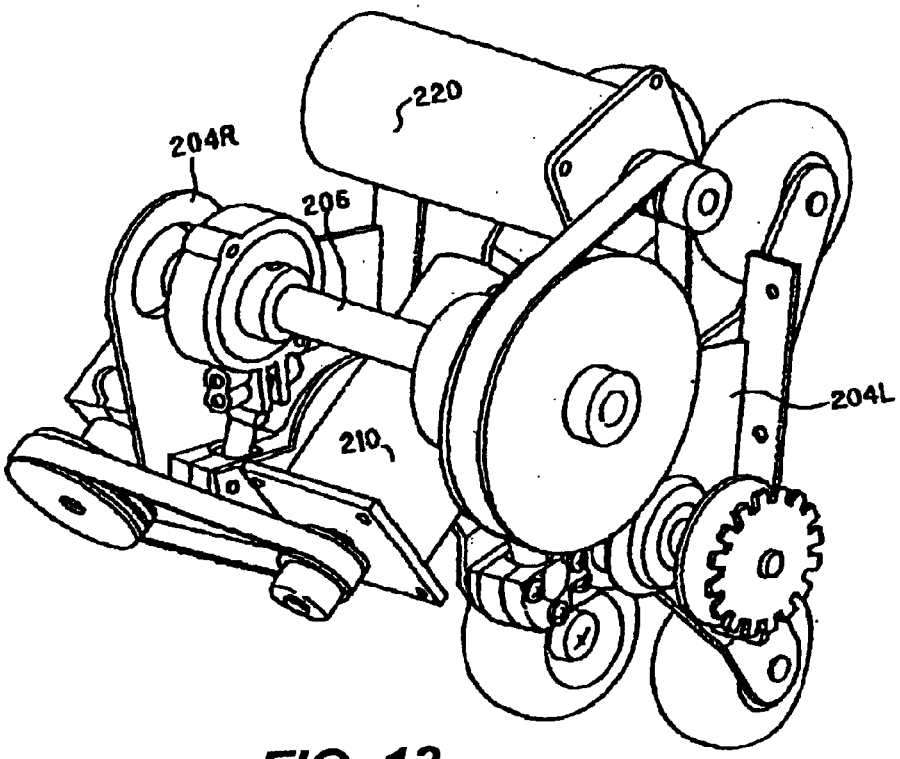
FIG. 13 is a diagonal back view of the treatment part taken from a lower position.

FIG. 8 is a front view of a treatment part 200 attached to the base board 111, FIG. 9 is its back view, FIG. 10 is its diagonal back view taken from an upward position, FIG. 11 is its frontal view taken from its right-hand side, FIG. 12 is its diagonal frontal view taken from the left-hand side, and FIG. 13 is its diagonal back view taken from a lower position. The four massaging members 201*a–d* are rotatably supported at the tips of approximately V-shaped arms 202R and 202L of which base parts are affixed to arm-supporting members 203R and 203L. These arm-supporting members 203R and 203L are affixed respectively to a side surface of a bearing case 2031R or 2031L. These bearing cases 2031R and 2031L are rotatably engaged with sloped sleeves 207R and 207L through bearings which rotate along the peripheral surfaces of the sloped sleeves 207R and 207L. The sloped sleeves 207R and 207L are cylindrically shaped and are affixed to a kneading shaft 205 obliquely from both sides with respect to its axial direction so as to slope symmetrically in the left-right direction. The bearing cases 2031R and 2031L are provided not only with a base part 20311R and 20311L for engaging with the outer periphery of corresponding one of the sloped sleeves 207 but also with a link receiving part 20312R or 20312L to which is engaged a spherically formed end of a link 209R or 209L supported so as to swing along the spherical surface.

A patting shaft 206 is disposed parallel to and above the kneading shaft 205. Cylindrical eccentric sleeves 208R and 208L made eccentric in radial direction are affixed to both sides of the patting shaft 206 at positions corresponding to the sloped sleeves 207. The two eccentric sleeves 208 are attached to the patting shaft 206 so as to be eccentric in opposite directions with respect to the patting shaft 206. Bearing cases 2081R and 2081L are rotatably engaged to the outer periphery of the eccentric sleeves 208R and 208L through bearings which rotate along the peripheral surface.

The eccentric sleeves 208 have a base part 20811R and 20811L engaged to the outer periphery and a link receiving part 20812R or 20812L protruding in the peripheral direction. One end of a link 209 (R or L) is connected to the bearing case 2031 (R or L), and the other end of the link 209 (R or L) is supported by the link receiving part 20812 (R or L) so as to swing in the axial direction of the patting shaft 206.

The kneading shaft 205 and the patting shaft 206 are rotatably supported from both sides through bearings by planar holder brackets 204R and 204L affixed to the baseboard 111.

Figure 14:
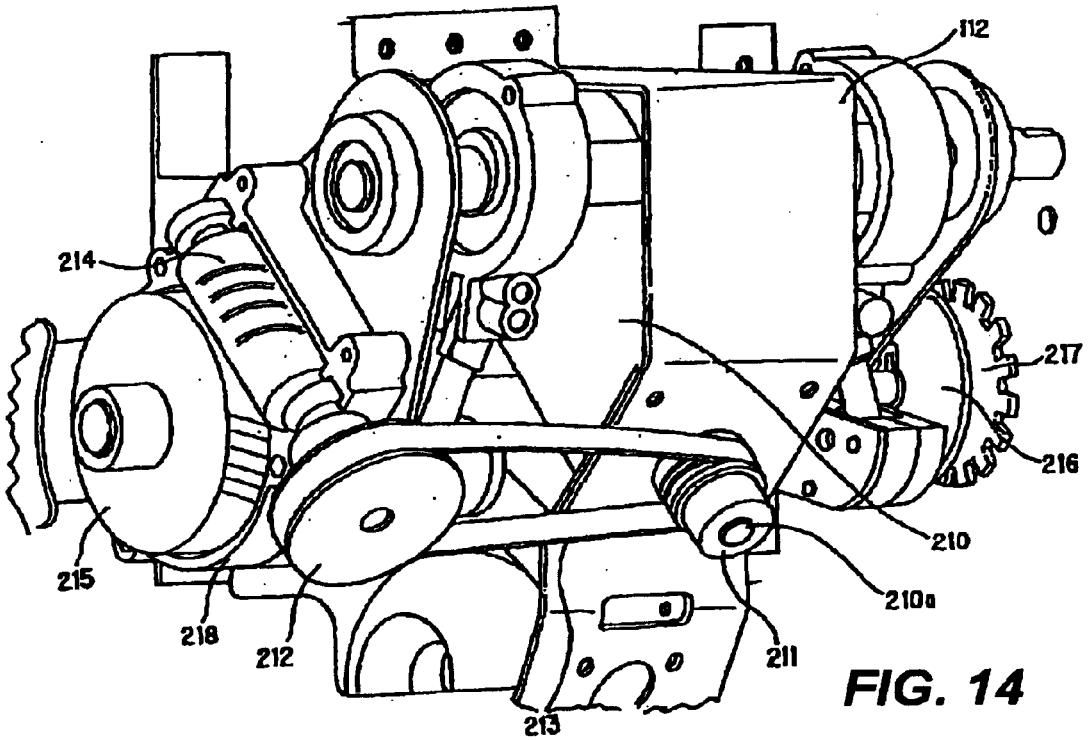
FIGS. 14 and 15 are back views of the kneading mechanism with some components removed for clarity.
Figure 15:
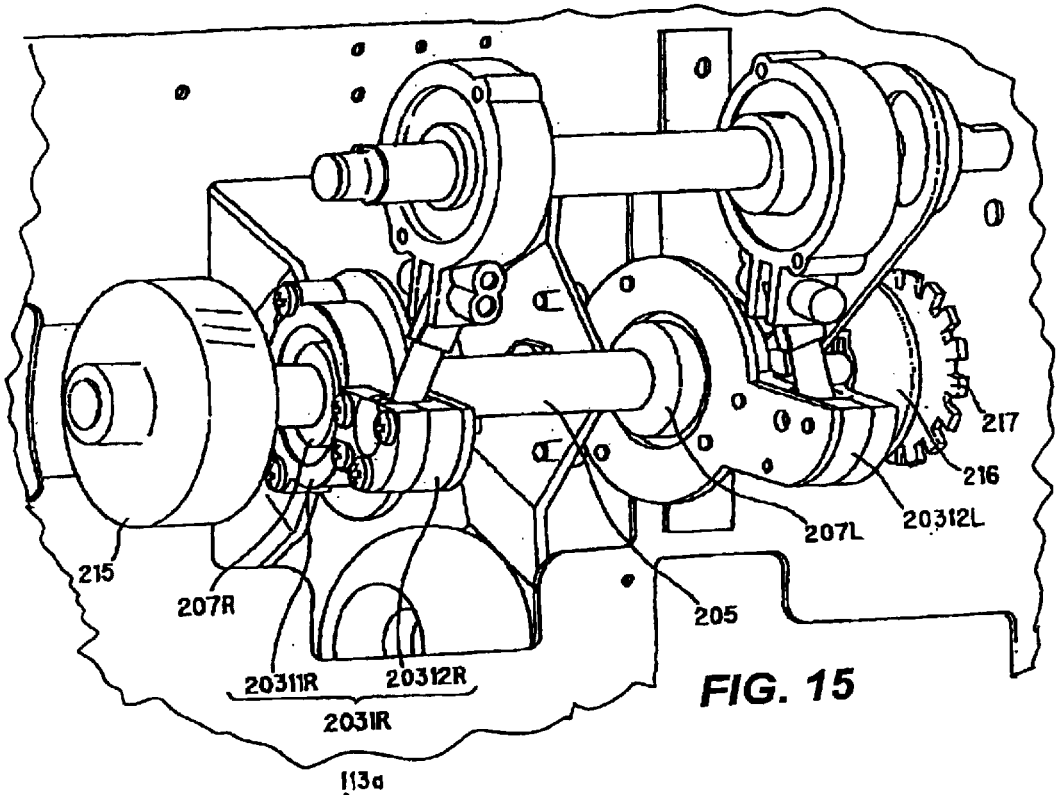

The structure of the kneading mechanism is described next with reference to FIGS. 14 and 15 which are both a back view of the base board 111 with some components removed for the purpose of disclosure. The kneading shaft 205 is operated by a motor 210 affixed to a planar supporting member 112 which is bent more or less into an M-shape, covering the back side of the kneading shaft 205 and the patting shaft 206 and having one end affixed to the backside of the base member 111. A small pulley 211 is affixed to the drive shaft 210*a* of the motor 210, supporting an endless belt 213 which is wound also around a larger pulley 212 affixed to the shaft of a worm gear 214. The worm gear 214 engages with a worm wheel 215 which is coaxially affixed to the outer circumference of the kneading shaft 205. The worm gear 214 and the worm wheel 215 are rotatably held inside a gear box 218 attached to the holder bracket 204R. Thus, the driving force of the motor 210 is communicated from the small pulley 211 to the endless belt 213 to the larger pulley 212 to the worm gear 214 to the worm wheel 215 while being decelerated, thereby causing the kneading shaft 205 to rotate.

Figure 16:
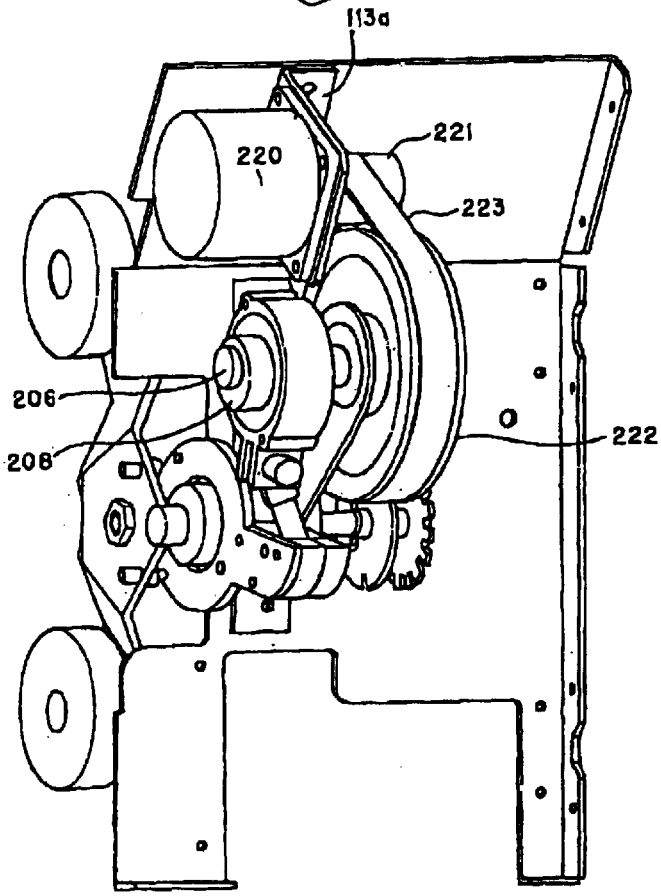
FIG. 16 is a drawing for showing the structure of the patting mechanism.
Figure 17:
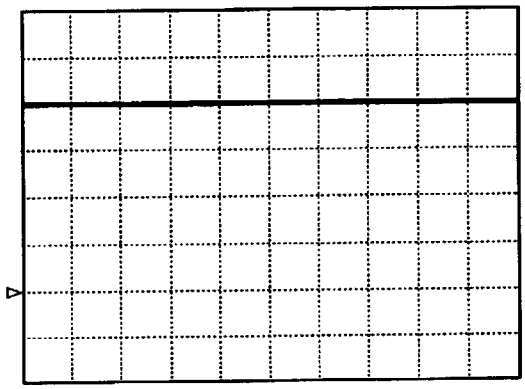
FIG. 17 (PRIOR ART)
FIG. 17 is a waveform diagram of an ordinary voltage applied to a massaging machine.

FIGS. 16 and 17 are referenced next to explain the patting operation by the massaging machine structured as explained above. The patting shaft 206 is driven by a motor 220 therefor affixed to the backside of the baseboard 111 through supporting members 113*a* and 113*b* as shown in FIG. 5. A small pulley 221 is attached to the drive shaft of the motor 220, and an endless belt 223 is stretched over this small pulley 221 and a large pulley 222 affixed coaxially to the patting shaft 206. Thus, the driving force of the motor 220 is communicated through the small pulley 221, the belt 223 and the patting shaft 206 while being decelerated. Mechanisms for moving the shaft upwards and downwards or forward and backward are not explained although they are provided.

For effecting a patting operation, the rotation of the kneading shaft 205 is stopped while the patting shaft 206 is activated. At this moment, the sloped sleeves 207 are positioned so as to be approximately perpendicular to the kneading shaft 205 of the arms 202R and 202L such that the massaging members are nearly perpendicular to the surface of the back ("zero point of kneading"). A detector plate 216 detecting the zero point of kneading and a kneading position indicator 217 are coaxially affixed to the kneading shaft 205 (as shown in FIG. 14). The zero point detector plate 216 is a disk-shaped member having a slit at one position on its outer periphery such that the zero point of kneading can be detected by means of a photosensor placed behind the base board 111 at a corresponding position so as to sandwich the detector plate 216.

Since the links 209 are supported rotatably through the eccentric sleeves 208 which rotate eccentrically with the rotation of the patting shaft 206, the distance between the axis of rotation of the patting shaft 206 and the link receiving parts 20312R and 20312L engaging the end parts of the patting shaft 206 changes as the patting shaft 206 is rotated.

Since the arms 202R and 202L are supported rotatably around the kneading shaft 205, the arms 202R and 202L swing around the kneading shaft 205 to effect the desired patting operation as the motor 220 is operated to rotate the patting shaft 206 at an appropriate speed.

Figure 18:
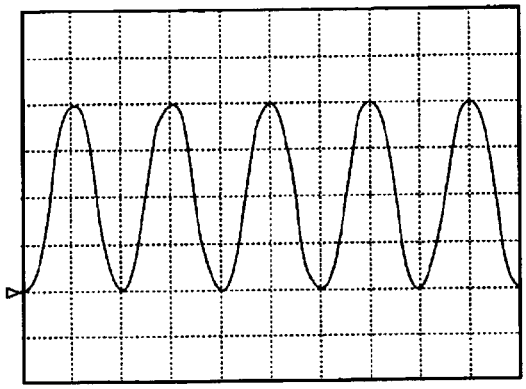
FIG. 18 (PRIOR ART)
FIG. 18 is a waveform of pressure felt by a patient when the massaging machine is operated according to FIG. 18.
Figure 19:
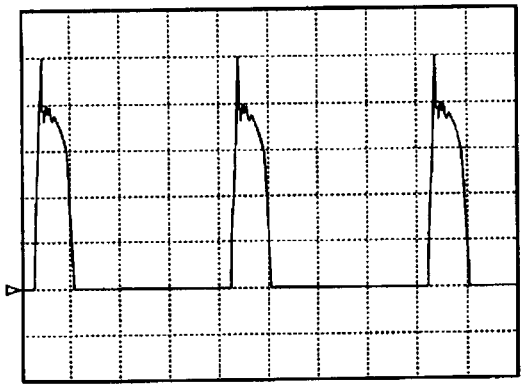
FIG. 19 (PRIOR ART)
FIG. 19 is a waveform of stimuli to a patient when massaged by a live masseur.

In this operation, if a constant voltage is applied continuously, as shown in FIG. 17, the pressure felt by the patient changes more or less sinusoidally as shown in FIG. 18 because of the aforementioned mechanism for causing the arms 202R and 202L to swing around the kneading shaft 205. In other words, after the pressure by the patting gradually increases, it gradually decreases and this is repeated over and over again. FIG. 18 shows an actually measured pressure change with respect to time, the vertical axis representing the pressure felt by the patient's body. If a masseur pats a patient's body by hand, by contrast, the stimulus waveform is as shown in FIG. 19. This shows clearly that the pressure rises rapidly as the masseur's hand touches the patient's body and after this high-pressure condition is maintained for some length of time, the pressure drops rapidly as the masseur's hand is separated from the patient's body. This is repeated as the masseur repeatedly pats the patient's body and this is what gives a pleasant sensation to the patient.

Figure 20:
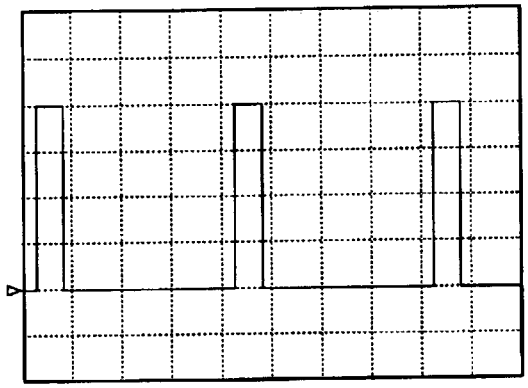
FIG. 20 is an example of waveform of the voltage applied according to this invention to a massaging machine.
Figure 21:
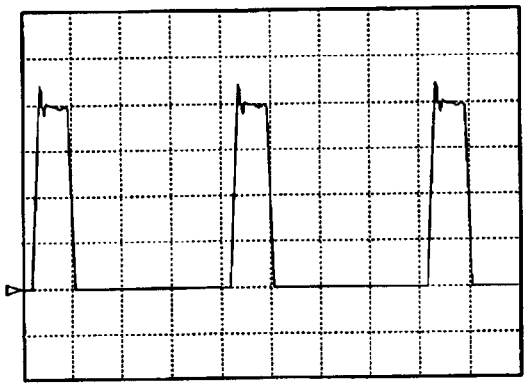
FIG. 21 is a waveform of stimuli by massaging according to this invention.

In view of the difference in waveform between FIGS. 18 and 19, it is not a constant voltage that is applied continuously to the motor but a pulsed voltage according to this invention. For example, a pulsed voltage of frequency about 2.5 Hz and duty ratio about 20% is applied as shown in FIG. 20. FIG. 21 is a measured pressure change on the patient's body when a pulsed voltage of FIG. 20 was applied to the motor. It clearly shows that the resultant pressure change experienced by the patient is quite similar to that given by a masseur.

Similar experiments were carried out on a plurality of individual patients. As shown in Table 1, while most of the tested individuals (91%) responded that the conventional operating mode hurt them, all of them found the mode according to this invention to be pleasant.

TABLE 1

| | Percentage of patients who felt it hurt | Percentage of patients who felt it was pleasant |
|---|---|---|
| Conventional method | 91% | 9% |
| Method of this invention | 0% | 100% |

When a pulsed voltage was thus applied, its frequency and duty ratio are important controlling factors. It was discovered that a pulsed voltage with frequency 1–10 Hz and duty ratio 2–8.5% is appropriate as shown in Table 2.

TABLE 2

| | Time |
|---|---|
| Time during which the motor is switched on | 0.02–1 sec |
| Time during which the motor is switched off | 0.1–1 sec |

Figure 22:
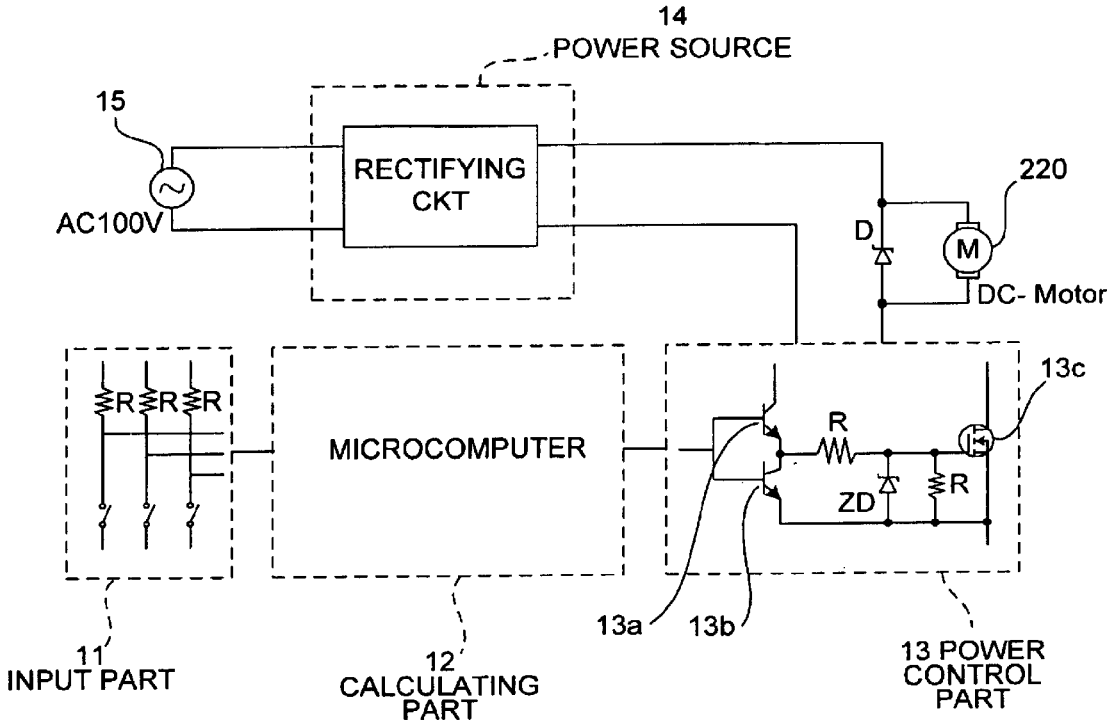
FIG. 22 is a block diagram of an example of circuit for inputting a pulsed waveform to the motor.

As described above, the present invention is characterized as applying a pulsed voltage to a motor for patting operation in massaging. FIG. 22 shows an example of driving circuit for providing such a voltage to the motor. For generating a pulsed voltage repeatedly outputted at specified intervals, any known pulse control method, pulse width modulation (PWM) method or phase control method may be used. In FIG. 22, numeral 11 indicates an input part comprising switches 11*a*, 11*b* and 11*c* for setting necessary conditions for generating a pulse with desired frequency and duty ratio. Numeral 12 indicates a calculating part which may comprise a microcomputer capable of generating and outputting required control signals from the input from the input part 11. A power control part 13 serves to receive the output from the calculating part 12 and to generate a power control signal for rotating the motor 220 for the patting operation. FIG. 22 shows an example wherein the power control part 13 is formed with two transistors 13*a* and 13*b* and a field effect transistor (FET) 13*c*. Numeral 14 indicates a power source for rectifying power from a commercial source 15 to supply power required by the motor 220.

In order to apply the pulse shown in FIG. 20 to the motor 220, the switches of the input part 11 are operated first to set the frequency and the duty ratio (say, to 2.5 Hz and 20%, respectively). The inputted data are transmitted to the calculating part 12 and the calculated result is transmitted to the power control part 13. The rectified voltage from the power source 14 is applied to the motor 220 but the transistors 13*a* and 13*b* and the FET 13*c* of the power control part 13 serve to switch on and off the source according to the output from the calculating part 12 to provide the pulsed voltage to the motor 220.

It now goes without saying that pulse width modulation can also be effected by adjusting the input part 11 in this manner.

Figure 23:
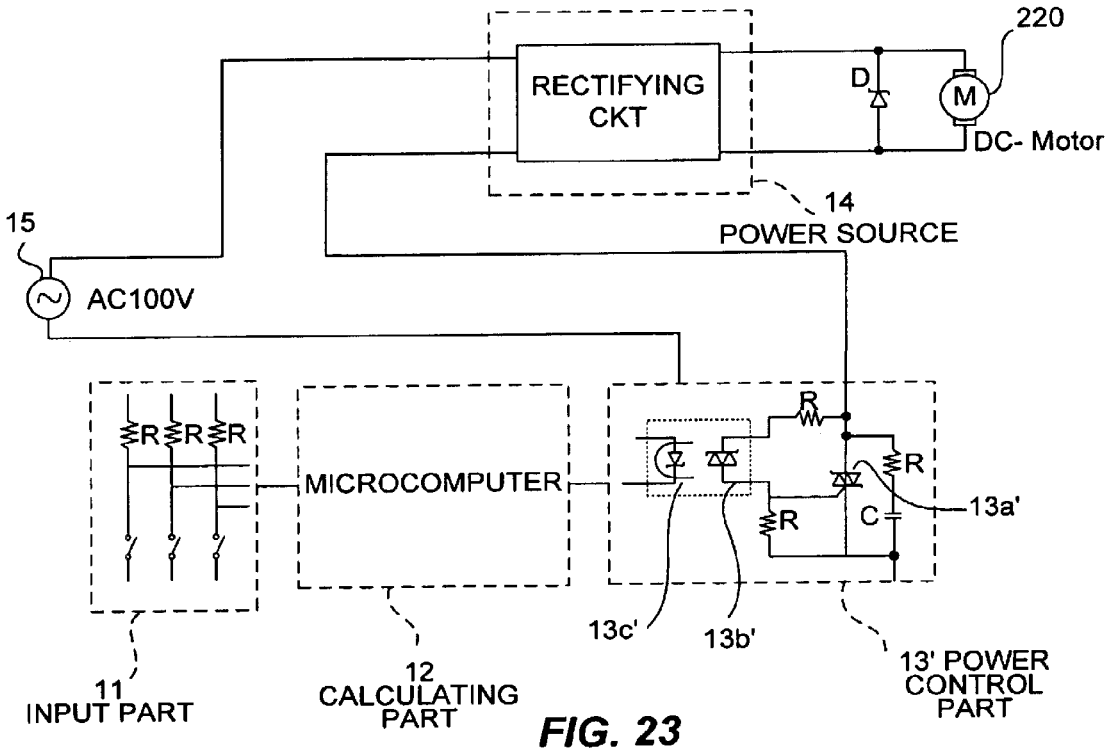
FIG. 23 is a block diagram of another example of circuit for inputting a pulsed waveform to the motor.

Next, an example of phase control method is explained whereby a portion of an AC waveform is cut off to produce a pulse form and it is electrically amplified to rotate a motor. FIG. 23 shows an example of a circuit for driving the motor for patting operation by the phase control method, indicating like parts by the same symbols as in FIG. 22.

With reference now to FIG. 23, the input part 11 allows the user to select whether a phase control should be started at a zero-cross point of a waveform from a commercial power source 15 and stopped at a specified position or it should be started at a specified position and stopped at a zero-cross, as well as a phase angle corresponding to the pulse width. The calculating part 12 comprises a microcomputer capable of generating and outputting required control signals from the input from the input part 11. The power control part 13' serves to receive the output from the calculating part 12 and to generate a power control signal for rotating the motor 220 for the patting operation. FIG. 23 shows an example wherein the power control part 13' is formed with a triac 13*a*' and a diac 13*b*' which is connected to the gate terminal of this triac 13*a*' and insulated from a light emitting diode 13*c*' by a photocoupler. Numeral 14 again indicates a power source for rectifying power from a commercial source 15 to supply power required by the motor 220.

In order to apply a specified pulse to the motor 220, the switches of the input part 11 are operated first to set the pulse rise position and phase angle with respect to the commercial power source 15 such as 50 Hz for frequency of repetition and 20% as duty ratio. The inputted data are used by the calculating part 12 and the calculated result is outputted to the power control part 13'. Voltage from the power source 14 is being applied to the motor 220 but the triac 13*a*' and the diac 13*b*' of the power control part 13' serve to switch on and off the current according to the output from the calculating part 12 to apply to the motor 220 a pulsed voltage obtained by cutting off a portion of the sinusoidal waveform of the commercial power source 15.

Although the invention was described above by way of examples but the essence is that a pulsed waveform or a similar waveform with variable frequency, duty ratio, pulse number, pulse width and pulse interval is electrically amplified and applied to the motor for patting operation.

Figure 24:
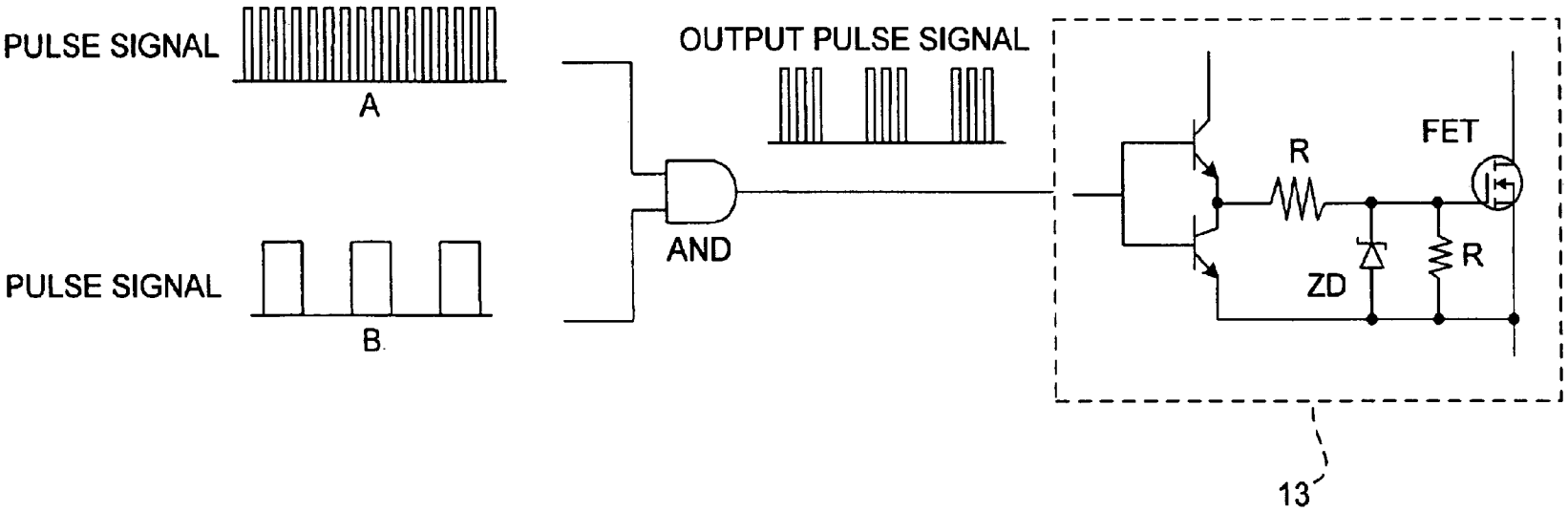
FIG. 24 is an example of control circuit for varying the patting strength.

A method of directly controlling the strength of patting is explained next. FIG. 24 shows an example of such method wherein another pulse signal B is superposed to a pulse signal A as shown above such that the width of pulse signal B is changed. For this purpose, a sinusoidal wave or a pulse signal B with higher frequency is generated and a logical product is taken with pulse signal A. The duty ratio of the sinusoidal wave or pulse signal B is changed and the outputted pulsed signal is used to drive the motor 220. This may be considered a kind of PWM method and if the duty ratio of pulse signal B is varied, the effective voltage value applied to the motor changes according to this ratio and a same effect is obtained as if the voltage has been varied or that the strength of the patting operation is varied.

Many modifications and variations of what has been described above are to be considered to be within the scope of this invention. For example, the waveform of the pulse to be applied to the motor 220 may be generated by the microcomputer. The strength of patting may be varied also by changing the voltage of the pulse applied to the motor 220 and thereby changing the rotation of the motor.

By either method, a pulse is modulated by another pulse so as to vary its effective voltage to be applied to the motor 220 such that the strength of patting is varied.

The method of present invention makes it possible to use the mechanism of a conventional massage machine and to give the patient a pleasant sensation of massaging like that by a live masseur, not achieved by prior art massage machines.

What is claimed is:

1. A method of controlling a massaging machine comprising the steps of:

providing said massaging machine with massaging members, arms that support said massaging members and are rotatably supported by a kneading shaft, a patting shaft supported parallel to said kneading shaft, eccentric members attached to said patting shaft, a link that connects said eccentric members with said arms, and a motor for rotating said patting shaft; and applying to said motor a driving signal for repetitively switching on and off said motor for specified time lengths, thereby activating said motor intermittently to cause the massaging members to vibrate while undergoing patting motion, communicating driving power of said motor to said patting shaft, causing said arms to swing around said kneading shaft through said link by eccentric rotary motion of said eccentric members, and thereby causing said massaging members to undergo patting motion.

2. The method of claim 1 wherein one or more variables of the group consisting of pulse frequency, duty ratio, pulse number, pulse width and pulse interval are changed to vary the frequency by which said massaging members pat the patient.

3. The method of claim 2 wherein an electrical voltage is applied to said motor as said driving signal and wherein said method includes the step of varying said voltage.

4. The method of claim 2 wherein an electrical voltage is applied to said motor as said driving signal and wherein said method includes the step of varying said voltage.

5. The method of claim 3 wherein the strength with which said massaging members pat the patient is varied by carrying out pulse width modulation on the voltage applied to said motor as said driving signal to thereby vary the pulse width of said voltage.

* * * * *

UNITED STATES PATENT AND TRADEMARK OFFICE

CERTIFICATE OF CORRECTION

PATENT NO. : 6,932,779 B2
DATED : August 23, 2005
INVENTOR(S) : Eiji Kasai

It is certified that error appears in the above-identified patent and that said Letters Patent is hereby corrected as shown below:

Title page,
Item [73], Assignee, change "OMRON Corporation" to -- OMRON Healthcare Co., Ltd. --.

Signed and Sealed this

Twenty-seventh Day of December, 2005

JON W. DUDAS
*Director of the United States Patent and Trademark Office*